US005390525A

United States Patent [19]

Fisch

[11] Patent Number: 5,390,525

[45] Date of Patent: Feb. 21, 1995

[54] INDEXING CONVEYOR FOR A DIE TRANSFER SYSTEM

[75] Inventor: Alfred C. Fisch, Clarkston, Mich.

[73] Assignee: Rapindex Incorporated, Bloomfield Hills, Mich.

[21] Appl. No.: 160,241

[22] Filed: Dec. 2, 1993

[51] Int. Cl.[6] ..... B21D 43/05

[52] U.S. Cl. ..... 72/405

[58] Field of Search ..... 72/405, 421, 422; 198/621, 861.5

[56] References Cited

U.S. PATENT DOCUMENTS

| | | | |
|---|---|---|---|
| 4,186,589 | 2/1980 | Criblez | 72/421 |
| 4,449,390 | 5/1984 | Pontini | 72/405 |
| 5,035,134 | 7/1991 | Fisch | 72/405 |
| 5,131,256 | 7/1992 | Sofy | 72/405 |
| 5,136,874 | 8/1992 | Fisch | 72/405 |
| 5,140,839 | 8/1992 | Burns | 198/621 |

FOREIGN PATENT DOCUMENTS

| | | | |
|---|---|---|---|
| 192834 | 7/1990 | Japan | 72/405 |

*Primary Examiner*—Daniel C. Crane

*Attorney, Agent, or Firm*—Barnes, Kisselle, Raisch, Choate, Whittemore & Hulbert

[57] ABSTRACT

A die transfer system that includes a lower die, an upper die carried for reciprocal movement toward and away from the lower die to perform at least one operation on a workpiece positioned therebetween, and a conveyor arrangement for sequentially conveying workpieces between the dies. The conveyor arrangement includes a pair of conveyors disposed on laterally opposed sides of the lower die, with each of the conveyors having hands for engaging successive workpieces and indexing the workpieces longitudinally of the lower die between the die stations. At least one of the conveyors is mounted to a fixed support base for selectively swinging such conveyor laterally away from the lower die to afford operator access to such conveyor and the lower die.

7 Claims, 2 Drawing Sheets

INDEXING CONVEYOR FOR A DIE TRANSFER SYSTEM

The present application is directed to a die transfer system, and more particularly to an improved conveyor for indexing workpieces through successive stations of the die assembly.

BACKGROUND AND OBJECTS OF THE INVENTION

In so-called progressive die systems, workpieces formed from strip stock remain attached to webs that extend along lateral edges of the pieces to facilitate indexing of the workpieces through successive stages of the die assembly. Although such arrangements facilitate conveyance of workpieces through the die stations, they possess the disadvantage that the workpieces must be formed in a linear array at spaced locations along the strip stock, leading to substantial inefficiency and waste. Furthermore, the fact that all workpieces remain interconnected during at least a major portion of the die operation can lead to difficulty and inefficiency in performing operations on the workpieces at a given station. For these reasons and others, so-called die transfer systems have been developed in which the workpieces are pre-separated and fed to individual units of the die arrangement. A die transfer system of this character permits more efficient use of the strip stock material, and also permits greater flexibility in operations that can be performed at the individual die stations. However, the conveyor arrangement for indexing individual workpieces through a die transfer system is more complex than those in typical progressive die systems, usually involving release and re-engagement with the workpieces at each of the individual die stations.

U.S. Pat. No. 5,136,874, assigned to the assignee hereof, discloses a die transfer system that includes a lower die, an upper die carried for reciprocal vertical movement toward and away from the lower die to perform at least one operation on a workpiece positioned therebetween, and a conveyor arrangement for sequentially conveying workpieces between the dies. The conveyor arrangement has a pair of conveyors disposed on opposite lateral sides of the lower die. Each conveyor includes a plurality of hands for gripping workpieces, with the hands being spaced from each other lengthwise of the conveyor by distances corresponding to stations of the die. Each conveyor and its associated hands are indexed in a longitudinal direction through the die between stations in synchronism with motion of the upper die. The hands are moved simultaneously in at least one direction perpendicular to the longitudinal indexing direction by a camshaft that extends through the stations along an axis parallel to the indexing direction. A cam is mounted on each camshaft for rotation with the camshaft in synchronism with motion of the upper die. A follower arrangement couples each cam to the hands of the associated conveyor, so that reciprocal rotation of the camshaft about its axis results in reciprocal motion of the hands in one or more directions lateral to the longitudinal direction of conveyance of workpieces through the die stations. The conveyor camshafts are rotated by cam-and-follower arrangements coupled to the upper die, or by electric servo motors controlled by a master controller.

Although the die transfer system and indexing conveyor arrangement disclosed in the noted patent address and overcome problems and deficiencies theretofore extant in the art, further improvements remain desirable. For example, it is occasionally desirable to afford operator access to the workpiece hands of the conveyor and/or to the forming elements of the die either for purposes of maintenance, or for purposes of change-over to workpieces of different configuration. A general object of the present invention, therefore, is to provide a die transfer system of the character described above that features an improved conveyor arrangement with facility for providing operator access to the conveyor and/or lower die for maintenance, repair and/or change-over purposes and the like. Another and more specific object of the present invention is to provide a die transfer system of the described character that is economical in construction.

SUMMARY OF THE INVENTION

A die transfer system in accordance with the present invention includes a lower die, an upper die carried for reciprocal movement toward and away from the lower die to perform at least one operation on a workpiece positioned therebetween, and a conveyor arrangement for sequentially conveying workpieces between the dies. The conveyor arrangement includes a pair of conveyors disposed on laterally opposed sides of the lower die, with each of the conveyors having hands for engaging successive workpieces and indexing the workpieces longitudinally of the lower die between the die stations. At least one of the conveyors is mounted to a support base for selectively swinging such conveyor laterally away from the lower die to afford operator access to such conveyor and the lower die.

In the preferred embodiment of the invention, each conveyor is mounted to the support base to pivot about an associated axis parallel to the longitudinal indexing direction and above the lower die, so that the conveyors may be selectively swung laterally away from and above the lower die. Each conveyor swing axis is defined by a shaft carried by the base on which the conveyor is mounted. A motor is coupled to the shaft through a gear box, and is responsive to an operator for selectively swinging the conveyor upwardly away from and downwardly toward the lower die under control of the operator.

BRIEF DESCRIPTION OF THE DRAWINGS

The invention, together with additional objects, features and advantages thereof, will be best understood form the following description, the appended claims and the accompanying drawings in which:

DETAILED DESCRIPTION OF PREFERRED EMBODIMENT

Figure 1:
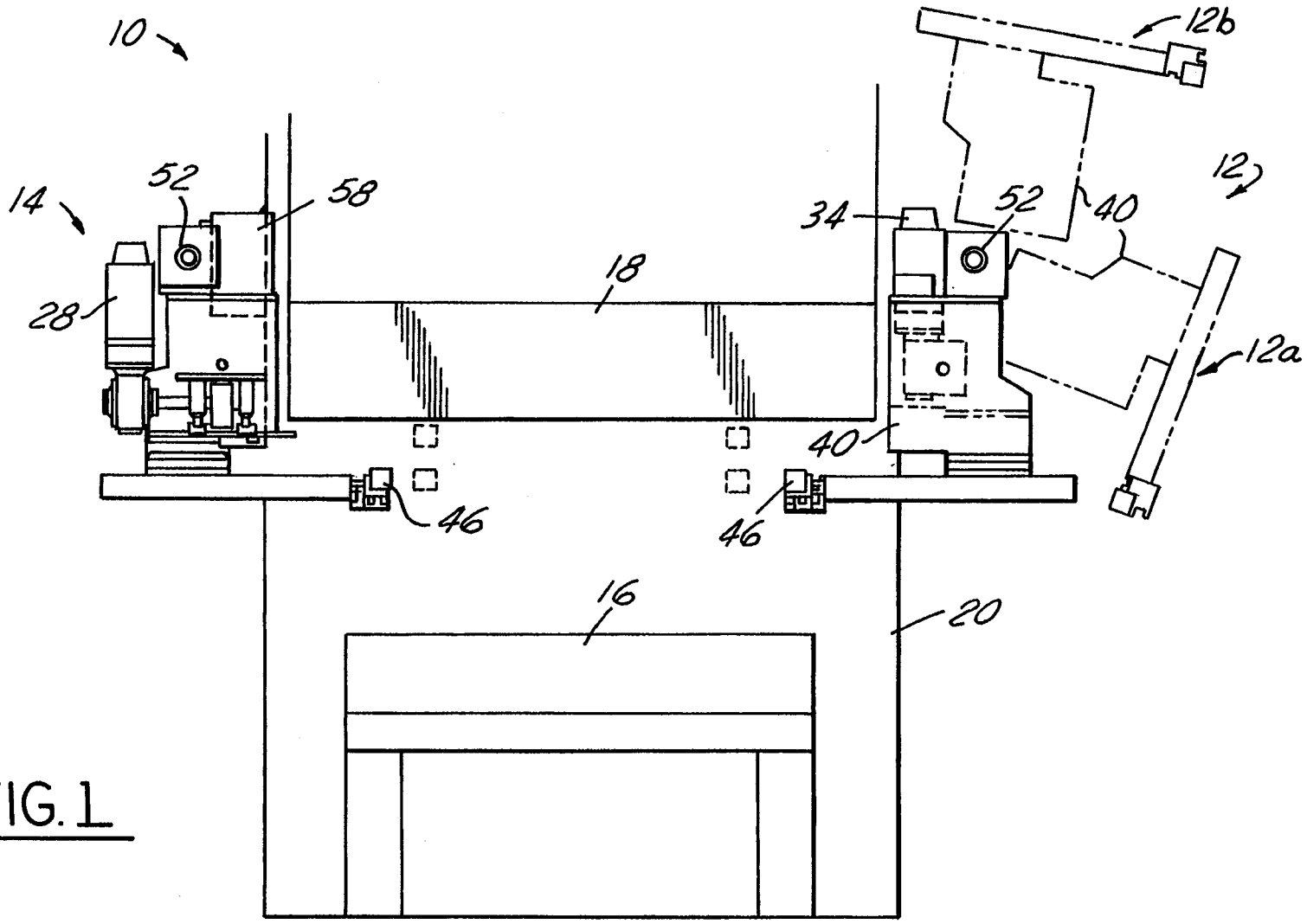
FIG. 1 is a schematic end view of a die transfer system with conveyor in accordance with a presently preferred embodiment of the invention.
Figure 2:
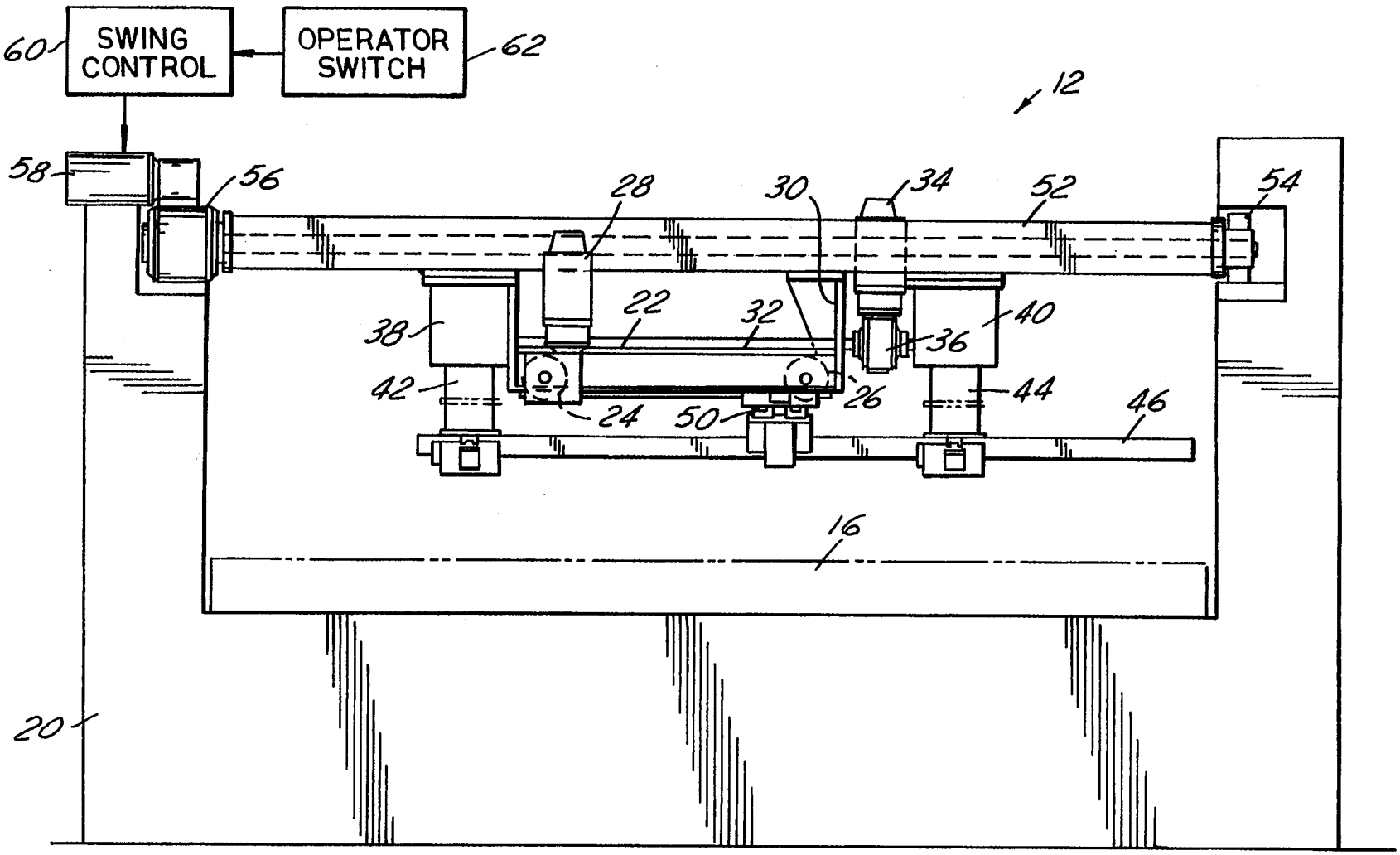
FIG. 2 is a side elevational schematic view of the die transfer system illustrated in FIG. 1.

FIGS. 1–2 illustrate a die transfer system 10 in accordance with a presently preferred embodiment of the invention for indexing workpieces through successive stations of a workpiece die. A pair of workpiece conveyors 12,14 are positioned on laterally opposed sides of a lower die 16, and an upper die 18 is carried by a fixed press support base or frame 20 for vertical reciprocation with respect to lower die 16. In general, conveyors 12,14 cooperate with the upper and lower dies to define a workpiece load station at the upstream end of the conveyors, an unload station at the downstream end of the conveyors, and at least one station positioned therebetween at which a desired operation(s) is performed on each workpiece upon descent of the upper die. Details of the dies, the geometry of the workpieces and of operations performed thereon by the dies, are not directly germane to the present invention.

In general, the constructions of conveyors 12,14 are mirror images of each other. Each conveyor 12,14 includes an endless loop conveyor having a belt 22 trained over a pair of pulleys 24,26 (FIG. 2) spaced from each other in the longitudinal direction of workpiece conveyance. Belt 22 is driven by an electronic servo motor 28, which in turn is controlled by a motor controller. A carriage 30 supports a camshaft 32 that is driven by an electric servo motor 34 through a gearbox 36. Camshaft 32 is coupled at opposed ends to longitudinally spaced cam arrangements that are enclosed by cam housings 38,40. The cams are coupled by carriages 42,44 to a transfer bar 46 that extends longitudinally of lower die 16. At least one workpiece hand is carried by transfer bar 46, and is coupled to belt 22 by a suitable slide and bearing arrangement 50. In general, the hands are indexed longitudinally of the conveyor and lower die by operation of servo motor 28, and is moved laterally inwardly and outwardly with respect to the lower die and the opposing conveyor, and upwardly and downwardly with respect to the lower die, by operation of transfer bar 46 and the cams within enclosures 38,40. To the extent thus far described, each conveyor 12,14 is the same as disclosed in above-noted U.S. Pat. No. 5,136,874, the disclosure of which is incorporated herein by reference for additional details of construction and operation of the conveyors.

In accordance with the present invention, at least one of the conveyors 12,14, and preferably both conveyors, is mounted to swing upwardly away from lower die 16 so as to afford easier operator access to the lower die and conveyors for purposes of maintenance, repair, tool change-over, etc. That is, frame 30 and cam enclosures 38,40 of conveyor 12 are affixed to a shaft 52. Shaft 52 is rotatably carried at one end by a bearing 54, and at the opposing end by a gearbox or transmission 56. Bearing 54 and transmission 56 are carried by die base or frame 20 so that shaft 52 is rotatable about a fixed axis parallel to the longitudinal direction of workpiece conveyance through the die transfer system and parallel to camshaft 32, and laterally outwardly and upwardly with respect to lower die 16. A motor 58 is carried by base 20 and operatively coupled to gearbox 56 for rotating shaft 52. Motor 58 is controlled by suitable swing control means 60, which in turn is responsive to an operator switch 62 for selectively swinging the conveyor away from or toward the lower die. Motor 58 may comprise an electric motor, with control 60 and switch 62 being suitable electronic control mechanisms. Alternatively, motor 58 may comprise an operator controlled hydraulic motor arrangement. Conveyor 14 is likewise carried by a shaft 52 (FIG. 1) and coupled to a motor 58 for swinging conveyor 14 away from or toward lower die 16.

In operation, when it is desired to repair or replace a workpiece hand and/or repair or replace forming elements on the lower or upper die 16,18, operation of the press and transfer system is terminated. The operator then activates operator switch 62 (FIG. 2) on one or both sides of the conveyor, driving the associated motor 58 and rotating the associated shaft 52 until the conveyor 12 or 14 is swung up and away from dies 16,18 by the desired amount. FIG. 1 illustrates an intermediate position **12*a* and a fully raised position 12*b* for pivoting conveyor 12 around the axis of shaft 52. Conveyor 14 may, of course, be pivoted about its shaft 52. In this connection, it is preferable that the conveyors be pivotable about their respective shafts independently of each other since, for a particular repair or replacement operation, it may not be necessary to pivot both conveyors by the same amount, or it may not be necessary to pivot one of the two conveyors at all. Preferably, each conveyor may be locked in any position between the lowered fully operational position illustrated in solid lines in FIG. 1, and upper fully retracted position 12*b***.

I claim:

1. A die transfer system that includes lower die means, upper die means carried for reciprocal movement along a vertical axis toward and away from said lower die means to perform at least one operation on a workpiece positioned therebetween, and means for sequentially conveying workpieces between said die means, said conveying means comprising:

a support base, a pair of conveyors disposed on laterally opposed sides of said lower die means, each of said conveyors including means for engaging successive workpieces and indexing the workpieces in a longitudinal direction with respect to said lower die means, and means mounting at least one of said conveyors to said base for selectively swinging such conveyor away from said lower die means in a vertical upward direction into an inoperative position, for operator access to the lower die and such conveyor, said mounting means comprising a shaft, means mounting said shaft on said support base to rotate about a fixed axis parallel to said longitudinal direction vertically above said one convey or and on a side of said one conveyor remote from said lower die means, said one conveyor being coupled to said shaft to rotate as a unit conjointly with said shaft laterally away from and vertically upwardly from said lower die means.

2. The system set forth in claim 1 wherein said mounting means includes means coupled to said shaft and responsive to an operator for selectively swinging said at least one conveyor laterally and upwardly away from said lower die means.

3. The system set forth in claim 2 wherein said means responsive to an operator includes a motor and means coupling said motor to said shaft.

4. The system set forth in claim 3 wherein said coupling means comprises a gearbox.

5. The system set forth in claim 3 wherein said motor comprises an electric motor.

6. The system set forth in claim 1 wherein said mounting means comprises means mounting each said conveyor to an associated said shaft for selectively swinging such conveyors laterally and upwardly away from said lower die means.

7. The system set forth in claim 6 wherein said mounting means includes means for swinging each said conveyor independently of the other.

* * * * *